United States Patent [19]

Ikeda et al.

[11] Patent Number: 4,871,990

[45] Date of Patent: Oct. 3, 1989

[54] CARTRIDGE FUSE

[75] Inventors: Tomohiro Ikeda; Yuji Hatagishi; Mitsuhiko Totsuka; Toshiharu Kudoh, all of Shizuoka, Japan

[73] Assignee: Yazaki Corporation, Japan

[21] Appl. No.: 236,245

[22] Filed: Aug. 25, 1988

[30] Foreign Application Priority Data

Aug. 25, 1987 [JP] Japan ..... 62-127998[U]

[51] Int. Cl.[4] ..... H01H 85/36; H01H 85/04

[52] U.S. Cl. ..... 337/238; 337/239; 337/261; 337/295

[58] Field of Search ..... 337/238, 239, 240, 261, 337/260, 295, 219

[56] References Cited

U.S. PATENT DOCUMENTS 1,867,784 7/1932 Trumbull ..... 337/261

4,672,352 6/1987 Takano ..... 337/295

*Primary Examiner*—H. Broome

*Attorney, Agent, or Firm*—Wigman & Cohen

[57] ABSTRACT

To provide a novel cartridge fuse which can prevent the melted fuse member ends from being shorted together after the fuse member has been blown out and to firmly hold terminal members connected by a fuse member within a housing, the cartridge fuse comprises a fuse housing formed with an insulating partition extending therewithin to some extent to form a pair of terminal compartments; a pair of opposing terminal members each formed with a stay portion extending beyond the insulating partition and a contact portion housed within the terminal compartment, a fuse member connected to the stay portions of the opposing terminal members; and elastic members for applying a tension to fuse member in the longitudinal direction thereof.

4 Claims, 5 Drawing Sheets

CARTRIDGE FUSE

BACKGROUND OF THE INVENTION

1. Field of the Invention

The present invention relates to a cartridge fuse and more specifically to a cartridge fuse provided with such a function that melted fuse ends are prevented from being shorted.

2. Description of the Prior Art

FIG. 1(A) shows an example of prior-art cartridge fuse which is disclosed in Japanese Published Examined (Kokoku) Utility Model Appli. No. 60-33578. This prior-art cartridge fuse FT is roughly composed of a fuse housing 10, a pair of female terminals 20, a fuse member (fusible conductor) 30, a spacer 40, and a housing cover 50. The fuse housing 10 is made of an insulating material such as a plastic and is formed with two insulating partitions 11, a contact holding inner wall 12, a lance engaging inner wall 13, and an inner projection 14. The female terminal 20 is formed with a contact portion 21, a lance portion 22 cut off and expanded from the contactor portion 21, and a stay portion 23. The spacer 40 is formed with an engagement groove 41. The spacer 40 is used to hold the two stay portions 23 of the female terminals 20. To subassemble the two female terminals 20, the stay portions 23 are first held by the spacer 40, and then the fuse member 30 is connected to the two top ends of the stay portions 23 of the female terminals 20.

The subassembly thus obtained is inserted into the fuse housing 10 in such a way that the contact portion 21 of the female terminal 20 is in contact with the insulating partition 11 of the housing 10; the lance portion 22 of the female terminal 20 is engaged with the lance engaging inner wall 13 of the housing 10; and the engagement groove 41 of the spacer 40 is engaged with the inner projection 14 of the housing 10. Therefore, when the subassembly is housed in the inner space of the housing 10, it is possible to stably house the two female terminals 20 within the fuse housing 10 without producing clearance between the female terminals 20 and the fuse housing 10.

In the prior-art cartridge fuse as shown in FIG. 1(A), as long as the two stay portions 23 of the female terminals 20 are connected to each other by the fuse member 30, it is possible to securely hold the female terminals 20 and the fuse member 30 within the housing 10. However, once the fuse member 30 is blown out, the two female terminals 20 become movable. Therefore, there exists a problem in that when the entire cartridge fuse is vibrated, the two female terminals 20 moves toward the center of the housing 10 by the elastic forces of the lance portions 22 and therefore both the melted fuse member ends are brought into contact with each other, thus resulting in a reconnection of the melted fuse member.

SUMMARY OF THE INVENTION

With these problems in mind, therefore, it is the primary object of the present invention to provide a novel cartridge fuse which can prevent the melted fuse member ends from being shorted again after the fuse member has been blow out.

To achieve the above-mentioned object, a cartridge fuse according to the present invention comprises: (a) a fuse housing formed with an insulating partition extending therewithin to form a pair of terminal compartments; (b) a pair of opposing terminal members each formed with a stay portion extending beyond the insulating partition and a contact portion housed within the terminal compartment and connectable to one of a pair of mating terminal members; (c) a fuse member connected to the stay portions of said opposing terminal members so as to cross over the insulating partition; and (d) spring force means, disposed within said fuse housing, for applying a tension force to said fuse member in a longitudinal direction thereof.

The tension applying spring force means is a resilient means is an elastic member disposed between the terminal member and the insulating partition of the fuse housing. The resilient member includes a pair of semicircular members each having a straight end portion, formed integral with the opposing terminal member.

In the cartridge fuse according to the present invention, since a tension force is applied to the fuse member by the resilient member, whenever the fuse member is melted away, it is possible to effectively prevent the melted fuse member from being shorted again. Further, the terminal members are always held stably within the fuse housing, even under the normal conditions (when the fuse member is not blown out) without producing a clearance within the housing or a sound from the housing.

BRIEF DESCRIPTION OF THE DRAWINGS

The features and advantages according to the present invention over the prior art will be more clearly appreciated from the following description of the preferred embodiment of the invention taken in conjunction with the accompanying drawings in which.

DETAILED DESCRIPTION OF THE PREFERRED EMBODIMENTS

Figure 1A:
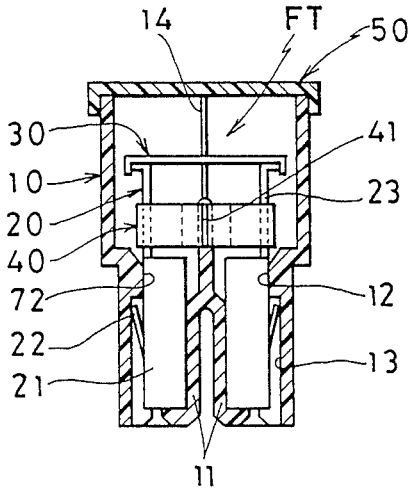
FIG.1(A) (Prior Art)
FIG. 1(A) is a cross-sectional partial side view, showing a prior-art cartridge fuse.
Figure 1B:
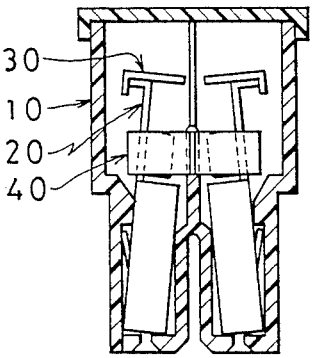
FIG.1(B) (Prior Art)
FIG. 1(B) is a similar cross-sectional view, for assistance in explaining a problem involved in the prior-art cartridge fuse shown in FIG. 1(A)

With reference to the attached drawings, the cartridge fuse of the present invention will be described in more detail hereinbelow.

The cartridge fuse FT of the present invention generally comprises a fuse housing 100; a pair of opposing female terminal members 200 housed within the fuse housing 100, a fuse member 300 for connecting the opposing female terminal members 200, and a transparent fuse cover 400 (e.g. resin-based) for covering the top of the fuse housing 100. The fuse housing 100 is made of an insulating material such as a plastic and is formed with an insulating partition 101 partially extending axially within the housing 100 so as to form a pair of terminal compartments, a pair of female terminal holding inner wall 102, and a lance engaging inner wall 103.

Figure 4:
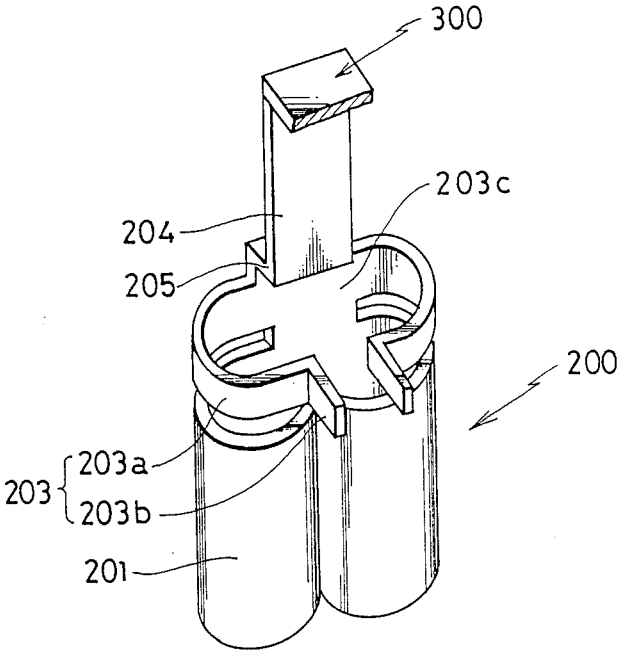
FIG. 4 is a perspective view showing the same female terminal connected to the fuse member as shown in FIG. 3.

Each female terminal member 200 is formed with a pair of opposing semicylindrical female contact portions 201 to which a tab-shaped male terminal (not shown) is inserted; a lance portion 202 cut from and expanded outward from the contact portion 201; a pair of resilient members 203 each having opposing semicircular portions 203*a* formed integral with a straight end portion 203*b*; and a straight stay portion 204 as depicted in FIG. 4. These two female terminals 200 are connected by the fuse member 300 at the top ends of the stay portions 204 thereof.

The above-mentioned two female terminal members 200 connected by the fuse member 300 are housed within the fuse housing 100 in such a way that the two female contact portions 201 are in contact with the female terminal holding inner wall 102, and the lance portions 202 of the terminal member 200 is engaged with the lance engaging inner wall 103 of the housing 100. In other words, the two opposing contact portions 201 are housed within the terminal compartments formed in the housing 100 and the stay portions 204 of the terminal members 200 are located beyond the insulating partition 101.

The objective of the cartridge fuse of the present invention is to form the female terminal member 200 with a pair of two opposing semicircular resilient member 203. As best shown in FIG. 4, this resilient member 203 is formed integral with the contact portion 201 at the middle portion thereof. As described already, the resilient member 203 includes a pair semicircular portion 203*a* each having a straight end portion 203*b*.

Figure 2:
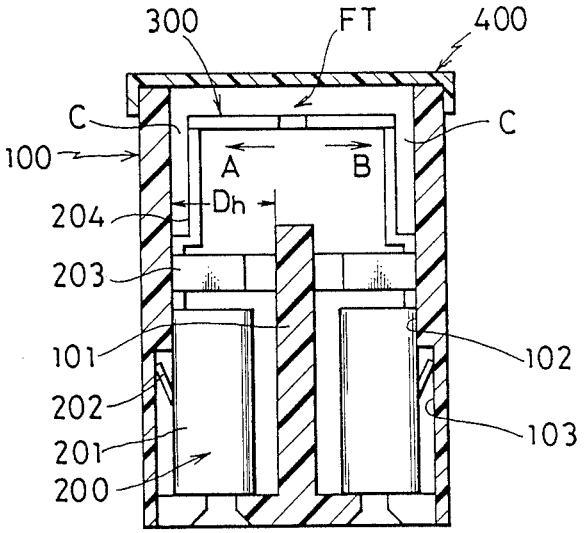
FIG. 2 is a cross-sectional side view, showing an embodiment of the cartridge fuse according to the present invention.
Figure 3:
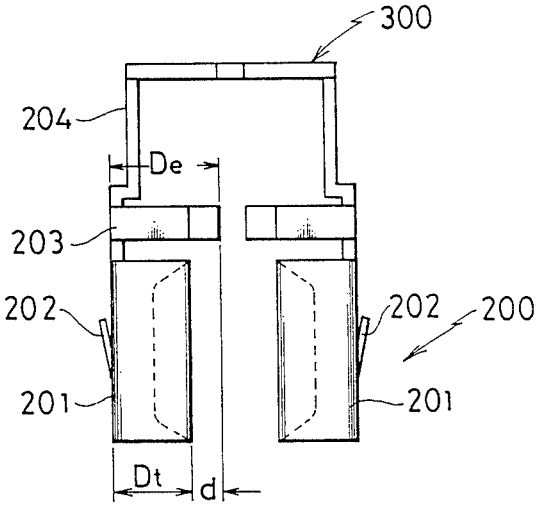
FIG. 3 is a side view showing a pair of female terminals connected by a fuse member of the present invention.

In FIGS. 2 and 3, the radial distance $D_e$ of the resilient member 203 is determined to be greater by a radial distance d than that $D_f$ of the female contact terminal 201. Further, the radial distance $D_h$ between the inner wall 102 of the housing 100 and the insulating partition 101 is greater than the radial distance $D_f$ of the female terminal member 200, but to be smaller than that $D_e$ of the resilient member 203. Therefore, when the female terminal member 200 is housed within the fuse housing 100 the ends of the straight end portions 203*b* of the resilient members 203 are brought into pressure contact with the insulating partition 101, and further the semicircular portions 203*a* are urged radially outward toward the base plate 203*c* thereof (FIG. 4). Under these conditions, the base plate 203*c* of the terminal member 200 is brought into tight contact with the terminal holding inner wall 102 of the housing 100 and further a tension force is applied to the fuse member 300 in the longitudinal direction thereof as shown by arrows A and B in FIG. 2.

Figure 5:
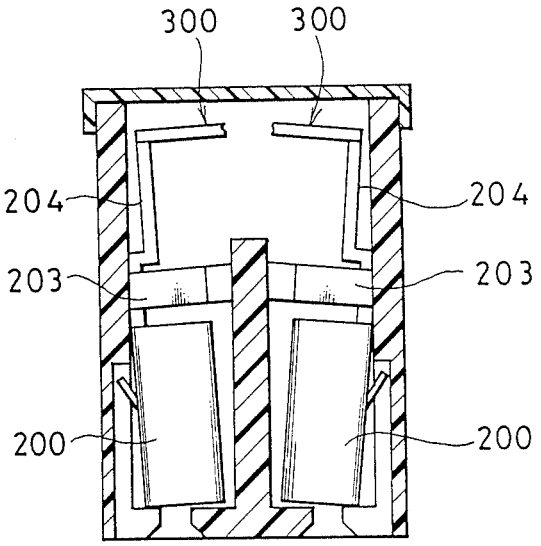
FIG. 5 is similar to FIG. 1(B) for assistance in explaining the effect of the cartridge fuse of the present invention.

As best shown in FIG. 2, the fuse stay portion 204 of the female terminal member 200 is housed with a space C away from the inner wall 102 of the housing 100. This space C serves to incline the stay portions 24 radially outward away from each other when the fuse member 300 is blown out, as shown in FIG. 5. However, this space C is not necessarily required. That is, it is possible to form the stay portion 204 straight along the female contact portion 201 and the base plate 203*c* thereof without providing a stepped portion 205 (FIG. 4) between the stay portion 204 and the base plate 203*c*. In this case the female terminal member 200 is brought into tight contact with the inner wall 102 extending along the longitudinal direction of the housing 100. In this case, when the fuse member 300 is melted away, although not inclined, the two stay portions 204 are securely separated from each other by the spring forces of the resilient members 203, thus preventing the melted fuse member ends from coming close to each other or shorted.

The function of the cartridge fuse of the present invention will be described hereinbelow. When two tab-shaped male terminals (not shown) are inserted into the female contact portions 201, a normal current can be passed through this cartridge fuse. However, when an excessive current over a rated value is passed therethrough, the fuse member 300 is melted away or blown off. However, since a tension force is applied to the fuse member 300 by the resilient members 203, the melted fuse ends are separated from each other as shown in FIG. 5. Therefore, even if an external force is applied to the cartridge fuse housing 100 from the outside or the housing 100 is vibrated, it is possible to effectively prevent the melted fuse members from being shorted again. In addition to the above-mentioned function attained after the fuse member 300 has been melted, the semicircular resilient members 203 serve to securely urge the two female terminal members 200 against the inner wall 102 of the fuse housing 100, thus it being possible to effectively prevent the two female terminal members 200 from being moved within the fuse housing 100 or to prevent the female terminal member 200 from producing abnormal noise.

Figure 6A:
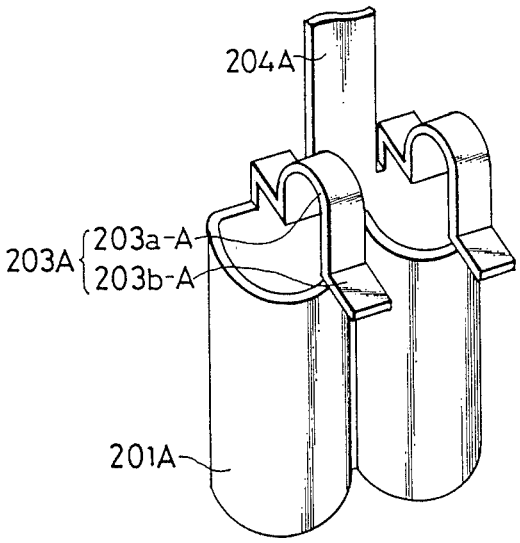
FIG. 6(A) is a perspective view showing another modification of the female terminal formed integral with the fuse member housed in the cartridge fuse according to the present invention.
Figure 6B:
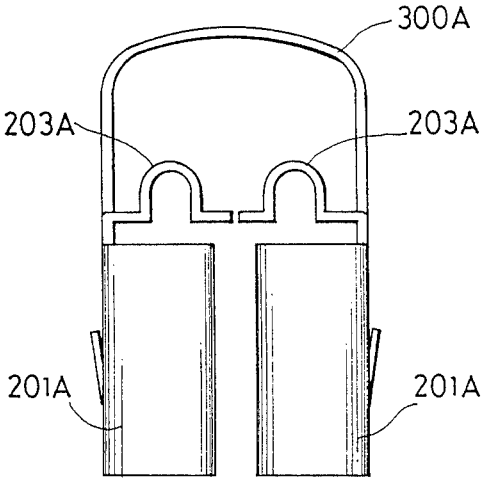
FIG. 6(B) is a side view showing a pair of the female terminals formed integral with the fuse member shown in FIG. 6(A)

FIG. 6(A) shows another modification of the female terminal member 200A housed in the housing 100. This terminal member 200A is formed with a pair of opposing semicylindrical female contact portion 201A to which a tab-shaped male terminal (not shown) is inserted; a pair of resilient members 203A having two parallel-arranged semicircular portions 203*a*-A each formed integral with a straight end portion 203*b*-A; and a straight stay portion 204A as depicted in FIG. 6(A). Further, these two female terminals 200A are formed integral with the fuse member 300A as shown in FIG. 6(B).

Being different from the female terminal member 200 shown in FIG. 4, in this modification, the semicircular portions 203*a*-A is formed over the contact portion 200A so as to extend along the axial direction of the semicylindrical female contact portion 201A.

Figure 7A:
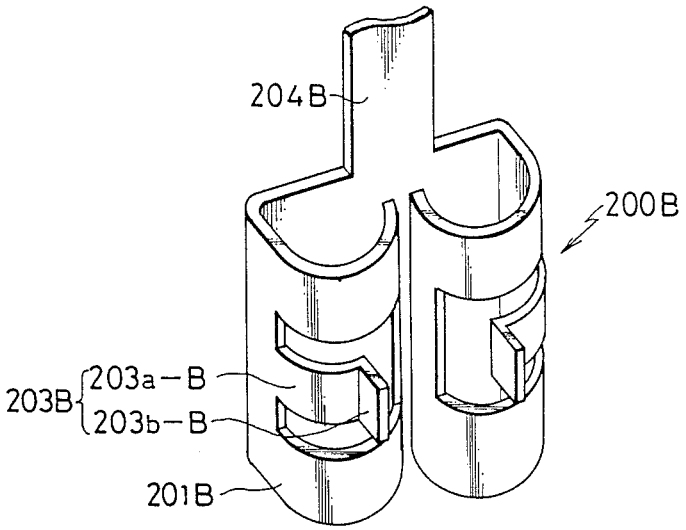
FIG. 7(A) is a perspective view showing still another modification of the female terminal formed integral with the fuse member housed in the cartridge fuse according to the present invention.
Figure 7B:
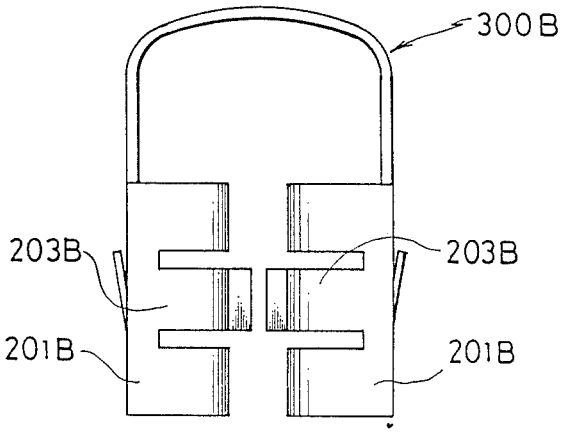
FIG. 7(B) is a side view showing a pair of the female terminals formed integral with the fuse member shown in FIG. 7(A).

FIG. 7(A) shows another modification of the female terminal member 200B housed in the housing 100. This terminal member 200B is formed with a pair of two opposing semicylindrical female contact portion 201B to which a tab-shaped male terminal (not shown) is inserted; a pair of resilient members 203B having two opposing circular-arc shaped portions 203*a*-B each formed integral with a straight end portion 203*b*-B; and a straight stay portion 204B as depicted in FIG. 7(A). Further, these two female terminals 200B are formed integral with the fuse member 300B as shown in FIG. 7(B).

Being different from the female terminal member 200 shown in FIG. 4, in this modification, the circular-arc shaped portion 203*a*-B is formed at the middle portion of the semicylindrical female contact portion 201B so as to extend along the outer circumference of the semicylindrical female contact portion 201B.

Further, the material of these female terminal member 200 is copper allow which has low creep characteristics at high temperature in order to secure high-temperature resilience. The copper alloy is phosphor bronze, beryllium copper, etc., for example.

Further, in the above embodiment, the resilient member 203 is formed integral with the female terminal member 200 in order to prevent the fuse member from being shorted again. Without being limited thereto, however, it is unnecessary to form the resilient member 203 integral with the female terminal member 200. That is, it is sufficient to alloy the resilient member 203 to only intervene between the inner wall 102 and the partition 101 of the fuse housing 100. Alternatively, it is possible to secure the resilient member 203 to the insulating partition 101 in such a way that the resilient member 203 is located between the female terminal member 200 and the housing 100. In summary, one or more resilient members are disposed so that a tension force is applied to the fuse member 300 to separate the fuse members portions 300 away from each other when melted. Therefore, the shape, arrangement position, material etc. of the elastic member 200 are not limited to the above specific embodiments. Further, a cartridge fuse provided with two female terminal members 200 has been disclosed; however, it is of course possible to apply the resilient member 203 of the present invention to the cartridge fuse provided with two male terminals.

As described above, in the cartridge fuse according to the present invention, since resilient members are disposed between the fuse housing and the terminal members in such a way that a tension force is applied to a fuse member connected between the two terminal members; after the fuse member has been melted away, it is possible to effectively prevent the melted fuse member ends from being shorted again. Further, when the fuse member is not melted away, it is possible to securely hold the terminal members within the housing without producing a clearance within the housing or a sound from the housing.

What is claimed is:

1. An electrical cartridge fuse, comprising:

(a) a fuse housing having an insulating partition therein to form a pair of terminal compartments;

(b) a pair of opposing terminal members, each enclosed within a respective one of said terminal compartments, and each respective terminal member further including (i) means for making electrical contact, housed within a respective terminal compartment, (ii) a stay portion extending beyond said insulating partition, and (iii) resilient means for urging said stay portions apart; and (c) a fusible link joining said opposing terminal members so as to bridge said insulating partition.

2. A cartridge fuse according to claim 1, wherein said resilient means includes a pair of semicircular members each having a straight end portion and said semicircular members are formed over the contact means so as to extend in a radial direction of the contact means.

3. A cartridge fuse according to claim 1, wherein said resilient means includes a pair of semicircular members each having a straight end portion and said semicircular members are formed over the contact means so as to extend in an axial direction of the contact means.

4. A cartridge fuse according to claim 1, wherein said resilient means includes a pair of semicircular arc-shaped members each having a straight end portion, formed integral with said opposing terminal member at a central location of the contact means so as to extend along the outer circumference of the contact means.

* * * * *